United States Patent [19]

Danforth

[11] Patent Number: 4,935,304

[45] Date of Patent: Jun. 19, 1990

[54] WIRE AND CABLE COATING OF NON-BLENDED LINEAR ALTERNATING POLYKETONE POLYMER AND BLEND OF THE POLYKETONE WITH POLYURETHANE POLYMER

[75] Inventor: Richard L. Danforth, Missouri City, Tex.

[73] Assignee: Shell Oil Company, Houston, Tex.

[21] Appl. No.: 332,248

[22] Filed: Mar. 31, 1989

[51] Int. Cl.[5] ..... B05D 1/08

[52] U.S. Cl. ..... 428/423.1; 428/424.2; 525/455; 525/539

[58] Field of Search ..... 428/423.1, 424.2; 525/456, 4, 539

[56] References Cited

U.S. PATENT DOCUMENTS 4,851,482 7/1989 Danforth et al. ..... 525/539

*Primary Examiner*—Harold D. Anderson

[57] ABSTRACT

A wire and cable coating prepared from either a linear alternating polymer of carbon monoxide and at least one ethylenically unsaturated hydrocarbon or a blend of that polymer with a polyurethane polymer, and a method for making the coating.

2 Claims, No Drawings

WIRE AND CABLE COATING OF NON-BLENDED LINEAR ALTERNATING POLYKETONE POLYMER AND BLEND OF THE POLYKETONE WITH POLYURETHANE POLYMER

BACKGROUND OF THE INVENTION

This invention is concerned with wire and cable coatings prepared from an essentially non-blended polyketone polymer, as well as blends of thermoplastic polyurethane polymers with the novel polyketone polymers.

The general class of polyketone polymers having carbon monoxide and one or more ethylenically unsaturated hydrocarbons has been known for some years. Brubaker, U.S. Pat. No. 2,495,286, produced such polymers of relatively low carbon monoxide content in the presence of free radical catalysts such as benzoyl peroxide. British Patent No. 1,081,304 produced such polymers of higher carbon monoxide content in the presence of alkylphosphine complexes of palladium as catalyst. Nozaki extended the process to arylphosphine complexes of palladium. See, for example, U.S. Pat. No. 3,694,412.

More recently, the class of linear alternating polymers of carbon monoxide and unsaturated hydrocarbons, now known as polyketones, has become of greater interest, in part because of improved methods of production. Such methods are shown by European Patent Application Nos. 181,014 and 121,965. The disclosed processes employ, inter alia, a compound of a Group VIII metal such as palladium, an anion of a non-hydrohalogenic acid having a pKa below 2 and a bidentate ligand of phosphorus. The resulting polymers are generally high molecular weight thermoplastic polymers having utility in the production of articles such as containers for food and drink and parts for the automotive industry or structural members for use in the construction industry.

U.S. Pat. Nos. 3,689,460 and 3,694,412 disclose two other processes for preparing polyketones. The catalysts described therein are complexes of a palladium, chloride or allyl palladium chloride and two trihydrocarbyl phosphine monodentate-like ligands, such as triphenylphosphine.

Another process for preparing polyketones is discussed by Sen and Li in an article entitled "Novel Palladium (II)—Catalyzed Copolymerization of Carbon Monoxide With Olefins", J. Am. Chem. Soc., Vol. 104, 3520–3522 (1982). This process generates higher yield than the other disclosed processes.

The process for preparing polyketones, disclosed in European Patent Application No. 121,965 is directed towards a preparation of polyketones to obtain a high yield, wherein a mixture of carbon monoxide and alkenically unsaturated hydrocarbon is polymerized in the presence of a Group VIII metal catalyst containing ligands, wherein hydrocarbon groups are bonded to an element from Group Va, characterized in that, as catalyst, a complex compound is used that is obtained by reacting a palladium, cobalt or nickel compound, a bidente ligand of the general formula:

$$R_1R_2—M—R—M—R_3R_4,$$

in which M represents phosphorous, arsenic or antimony, $R_1$, $R_2$, $R_3$, and $R_4$ are identical or different hydrocarbon groups, and R represents a divalent organic bridging group having at least two carbon atoms in the bridge, none of these carbon atoms carrying substituents that may cause stearic hindrance, and an anion of an acid with a pKa of less than two, provided the acid is neither a hydrohalogenic acid nor a carboxylic acid.

Blends of uncured polyurethane elastomer (which has been processed in a particular manner) with a non-specific polyketone, have been taught in U.S. Pat. No. 2,833,740 issued to Verbanc and assigned to DuPont. The specific types of polyketone/polyurethane blends disclosed therein were prepared from ethylene/carbon monoxide copolymer having molecular weights of about 700 to 1500 to obtain ultraviolet degradable polyurethane. The ratio of ethylene to carbon monoxide in the polyketone was between 5:1 and 12:1. The polymers used therein were not the linear alternating polyketone polymers of the present invention.

Blends of the novel polyketone of the present invention with urethanes have been taught in copending application Ser. No. 187,192, filed April 28, 1988 (Attorney Docket No. T-4363). There exists a need for a novel coating for wires and cables which can be essentially the non-blended novel polyketone polymer of a blend of the novel polyketone with a urethane.

It has been desired to provide a wire and cable coating with a good variety of properties, including one or more of the following: toughness, softness, solvent resistance, abrasion resistance, pinch resistance, surface hardness, good conventional tensile and/or electrical properties for standard cable end uses and resistance to elevated temperatures. The present invention provides a novel cable coating with one ore more of these properties.

SUMMARY OF THE INVENTION

The present invention is a wire and cable coating prepared from a linear alternating polymer of carbon monoxide and at least one ethylenically unsaturated hydrocarbon and a coating made from a blend of a polyurethane polymer with the linear alternating polymers of carbon monoxide and at least one linear alternating polymer. The invention also relates to the process for making the novel coating as well as articles prepared using the novel coating.

DETAILED DESCRIPTION OF THE INVENTION

Preferred polyketone polymers usable to prepare these unique wire and cable coatings are copolymers of carbon monoxide and ethylene or terpolymers of carbon monoxide, ethylene and a second aliphatic α-olefin of 3 or more carbon atoms, particularly propylene.

Such polymers can be typically produced by contacting the carbon monoxide and the ethylenically unsaturated hydrocarbon(s) under polymerization conditions in the presence of a catalytic amount of a catalyst formed from a compound of the Group VIII metals palladium, cobalt or nickel, the anion of a non-hydrohalogenic acid of a pKa less than about 6, preferably less than about 2, and a bidentate ligand of phosphorus, arsenic or antimony. Although the scope of the polymerization is extensive, for purposes of illustration a preferred Group VIII metal compound is palladium acetate, the anion is the anion of an acid selected from trifluoroacetic acid and para-toluenesulfonic acid and the bidentate ligand is selected from 1,3-bis(diphenylphosphino)propane and 1,3-bis[di(2-methoxyphenyl)-phosphino]propane.

Polymerization is carried out at polymerization conditions, typically at elevated temperature and pressure, in the gaseous phase or in the liquid phase in the presence of an inert diluent, e.g., a lower alcohol such as methanol or ethanol. The reactants are contacted by conventional methods such as stirring or shaking and subsequent to reaction the polymer product is recovered as by decantation or filtration. The polymer product may contain metallic residues from the catalyst which are removed by contact with a solvent which is selective for the residues. Production of these polymers is illustrated, for example, by published European Patent Application Nos. 181,014 and 121,965.

The physical properties of the polyketone polymer usable in the wire and cable coating, will be determined in part by the molecular weight and by whether the polymer is a copolymer or a terpolymer. Typical melting points are from about 175° C. to about 300° C., more typically from about 190° C. to about 270° C. Polyketone polymers usable herein have preferred melting points of between about 190°-230° C. though polymers with melting points ranging from about 180° C. to about 270° C. may be usable herein.

The structure of the preferred polymers is that of a linear alternating polymer of carbon monoxide, ethylene and any second ethylenically unsaturated hydrocarbon. When terpolymers of carbon monoxide, ethylene and a second ethylenically unsaturated hydrocarbon, e.g., a hydrocarbon of at least 3 carbon atoms, are produced, there will be at least two units incorporating moieties of ethylene per unit incorporating a moiety of the second unsaturated hydrocarbon, preferably from about 10 units to about 100 units incorporating moieties of ethylene per unit incorporating a moiety of the second unsaturated hydrocarbon. The polymer chain of the preferred class of polymers is illustrated by the formula $$-[CO(C_2H_4)_x-[CO-(B)]_y-$$

wherein B is the moiety obtained by polymerization of the second ethylenically unsaturated hydrocarbon through the ethylenic unsaturation. The "—CO(B)—" with —CO($C_2H_4$)—, and —CO(B)— units and the —CO(B)— units occur randomly throughout the polymer molecule and the ratio of y:x is no more than about 0.5. In the modification of the invention which employs copolymers of carbon monoxide and ethylene without the presence of a second ethylenically unsaturated hydrocarbon, the term y is zero and the ratio of y:x is also 0. When terpolymers are employed, i.e., y is greater than 0, ratios of y:x from about 0.01 to about 0.1 are preferred. The end groups or "caps" of the polymer chain will depend on the particular materials present during its production and whether and how the polymer has been purified. The precise nature of the end groups is of little significance with regard to the overall properties of the polymer so that the polymer is fairly represented by the polymer chain as depicted above.

Useful polyketones for the novel wire and cable coatings have limiting viscosity numbers (LVN) as measured by the method wherein the polymer is dissolved in m-cresol at 60° C.; using a standard capillary viscosity measuring device, such as a Cannon-Ubbelohde viscometer in the range of 0.5 to 10 LVN and more preferably 0.8 to 4 LVN and most preferably 0.8 to 2.5 LVN.

The novel wire and cable coating can be prepared by the following process: preparing pellets of the polyketone polymer, and pouring the polymer pellets into a feeder attached to a 1½ inch Brabender single screw extruder. Different sizes of extruders may be used (i.e., even larger apparatus could be used herein). Twin screw extruders may be used, such as a Werner and Pfleiderer extruder. The feed rate can be set at different rates without affecting the resultant product. The pellets can be starve fed or flood fed into the hopper. The extruder can be run at a variety of speeds, preferably at 300 rpm for a 15 mm extruder.

Once heated and softened in the extruder, the contents of the extruder are extruded into a conventional cross-head die. After being unwound from a wire spool, wire or cable is simultaneously fed into the cross-head die with the polymer. The wire or cable is coated in the cross-head die with the polymer forming a coated wire, then the coated material is quenched or allowed to cool. Typically a water quench is used for coated copper wire, but other forms of quenching or cooling can be used. After quenching or cooling, the coated wire or cable is wound. The coated wire or cable can be wound around one or more capstans to maintain a uniformly coated wire or cable.

Wire and/or cable, such as 16 strand, 30 gauge, 18 ASW Camden wire, copper primary wire, available from Camden, can be coated with the novel polymer forming a unique coated article.

Wire and/or cable can be coated with a novel formulations of polyketone polymer or a novel blend of polyketone with polyurethane.

Polyurethane polymers usable for the novel blend formulations include thermoplastic polyurethanes such as polyester based polyurethanes and polyether based polyurethanes. It has been found that a variety of Estanes® available from B. F. Goodrich are suitable polyurethanes usable in the scope of the present invention. In particular, Estane® 58133 an ester based polyurethane is usable herein. Estane® 58881 which is an ether-based polyurethanes are with a Shore A80 and a processing temperature of 198° C. is usable herein.

The polyurethane polymers which may be used within the scope of the present invention include those which are prepared from long chain polyols reacted with diisocyanates and chain extenders. Polyols can be of two basic types, either polyester-type or polyether-type. Polyester-type polyols usable herein can be hydroxyl terminated polyesters prepared from adipic acid and an excess of glycol, such as ethylene glycol, neopentyl glycol, hexaediol-1,6, and the like or mixtures thereof. Polyethers usable herein include poly(oxypropylene) glycols and poly(oxytetramethylene) glycols. For example, polyalkyleneether glycols can be mixed with a molar excess of an organic diisocyanates to form urethane linkages in a linear polymer. This linear polymer can be reacted with a chain extending agent, such as water, diamine, a hydroxy-amine, or 1,4 butane Diol.

The term "polyalkyleneether glycol" refers to a polyalkyleneether which contains terminal hydroxy groups. These compounds for example, can be derived from the polymerization of cyclic ethers such as alkylene oxides or dioxolane or from the condensation of glycols. They are sometimes known as polyalkylene glycols or polyalkylene oxide glycols. Those useful herein may be represented by the formula $HO(RO)_nH$, in which R stands for an alkylene radical and n is an integer sufficiently large that the molecular weight of the compound is at least 750, i.e. large enough that the polyoxalkylene group —$(RO)_n$— has a formula weight of at least 732. Not all of the alkylene radicals present need be the same. Glycols containing a mixture of radicals, as in the compound $HO(CH_2OC_2H_4O)_nH$ can be used. These glycols are either viscous liquids or waxy solids. To be of value in preparing the usable polyurethanes, the molecular weight of the glycol should be at least 750 and may be as high as 10,000. The molecular weight is preferably between 750 and 3,500. Polytetramethyleneether glycol, also known as polybutyleneether glycol, is a preferred glycol. Polyethyleneether glycol, polypropyleneether glycol and poly-1,2-dimethylethyleneether glycol are representative of other operable compounds.

Additionally, polyether-thioether glycols, polyalkylene-arylene-ether glycols and polyalkylene-arylene-ether glycols are examples of this first class of polyols. Of the second class of polyols usable herein, e.g. the polyesters, there are conceptually two classes, poly(oxypropylene) glycols and poly(oxytetramethylene) glycols. As an example, polyalkylene ester glycols can be usable herein.

The term "polyalkyleneester glycol" refers to a polyalkyleneester which contains terminal hydroxy groups and may be represented by the formula $$HO(R\overset{\overset{O}{\|}}{C}O)_nH$$

in which R stands for an alkylene radical and n is an integer sufficiently large that the molecular weight of the compound is at least 750. Glycols can contain a mixture of radicals. The compound ethylene glycol, can be used with this ester. Other glycols can include 1,4-butanediol, 1,6-hexanediol, hydroquinone, bis(2-hydroxyethyl) ether, are representative of other operable compounds. The molecular weight of the glycol should be at least 750 and may be as high as 10,000. The molecular weight is preferably between 750 and 3500.

Any of a wide variety of diisocyanate compounds may be used in the polymerization to prepare the polyurethane polymer usable herein. Aromatic diisocyanates, such as toluene-2,4-diisocyanate (and its dimers), 4,4'-methylene-bis(phenyl isocyanate), 1,5-naphthylene diisocyanate and 4-tertbutyl m-phenylene diisocyanate are usable herein. Diphenyl methane diisocyanate may be particularly advantageous for use herein. This compound is available from Upjohn Polymer Chemicals as Isonate ® 215, and can be used in crude form or in pure form. Aliphatic compounds such as hexamethylene diisocyanate and tetramethylene diisocyanate, and the alicyclic compounds such as 1,4-cyclohexylene diisocyanate may be operable. Of the wide variety of diisocyanates usable herein, including but not limited to: 1,3-bis(3-isocyanato-p-tolyl) urea; 4,4'-methylene di-o-tolylisocyanate; 4-methoxy-m-phenylene diisocyanate; 4-propyloxy-m-phenylene diisocyanate; 4-chloro-m-phenylene diisocyante; 4-bromo-m-phenylene diisocyanate; hexamethylene diisocyanate; tetramethylene diisocyanate; and 1,4-cyclohexylene diisocyanate, may be operable herein.

In addition, the following polyisocyanates may be usable:

isophorone diisocyanate:

-continued

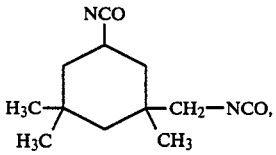

4,4'-dicyclohexylene methane diisocyanate:

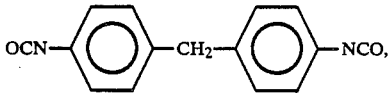

3,3'-dimethyl-4,4'-bisphenyl diisocyanate:

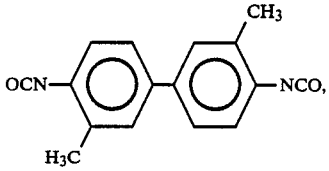

1,4-benzene diisocyanate:

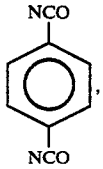

1,5-naphthalene diisocyanate:

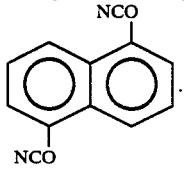

It is to be understood that these diisocyanates may be used either singly or in combination.

The chain-extending agent usable herein can contain a plurality of active hydrogen atoms, with up to two atoms in the molecule having active hydrogen attached thereto. A preferred chain extending agent is 1,4-butanediol. Suitable chain-extending agents include glycols, diamines, dicarboxy acids, dicarboxy amides, disulfonic acids and disulfonamides. Representative compounds include ethylene diamine, m-tolylene diamine, benzidine, diethylene glycol, hydrazine, succinic acid and 1,4-butanedisulfonic acid. (1,4-butanediol is available from Dupont.) More than one chain extending agent can be used herein.

The polyurethane polymer can be prepared by either mixing all of the ingredients together or by first reacting the polyol with the diisocyanate then reacting that combination with at least one chain extending agent either by batch method, in a mixing chamber, or in an extruder.

The coatings for wire and/or cable prepared from the unique polyurethane/polyketone blends are known to exhibit mechanical integrity.

The wire and cable coatings based on the blend formulations can be obtained by first blending together a mixture of (a) a polyketone polymer and (b) a polyurethane polymer and wherein components (a) and (b) are blended in relative proportions by weight within a range of from 1:99 to 99:1 parts based on 100 parts of (a)

and (b) combined, and second, coating a wire or cable with the resultant blend, forming a coated wire or cable.

A suitable blend for the novel wire and cable coating is based on 100 parts of (a) and (b) combined and is prepared from about 95 to 5 parts of (a) and, correspondingly, from about 5 to 95 parts of (b). Components (a) and (b) may also be blended in relative proportions ranging from about 20:80 to 80:20; 30:70 to 70:30; 40:60 to 60:40, and in equal amounts by weight, i.e. (a):(b)=50:50.

The blended wire and/or cable coating can be prepared by preparing the novel polyketone polymer, extruding the polymer into a strand, quenching the strand, then chopping the strand to form pellets. The pellets can then be mixed with polyurethane pellets, preferably in a drum or tumbler, though any similar mixing means can be used. The blended pellets can then be poured into a feeder attached to a 1½ inch Brabender single screw extruder, such as the kind used to prepare the nonblended polyketone coating. Other sizes and types of extruders can be used, preferably a 30 mm twin screw extruders by Werner Pfleiderer. The feed rate from hopper to extruder will be conventional and run at a rate that does not affect the resultant product. The pellets can be starve fed or flood fed into the hopper. The extruder can be run at a variety of speeds, though 300 rpm for a 15 mm extruder is preferred. Pellets of the blend are then formed from the extrudate. The blend pellets of polyketone and polyurethane can then be again extruded and then passed through the cross-head die coating. A wire or cable can be introduced into the die in the same manner as the non-blended polyketone coated wire or cable is prepared.

It is anticipated that polyketone blends prepared from all four types of polyurethanes, polyether-based, polyester based, low density thermoplastic polyurethanes, and high density polyurethanes will provide substantially similar behavior for wire and cable coatings. It is also anticipated that combinations of the different types of polyurethanes, when blended with polyketone, will also react in a similar manner and have utility herein.

The compositions of the invention, whether polyketone polymer with polyurethane or polyketone polymer without polyurethane, may be modified by one or more conventional additives such as inhibitors of oxidative, thermal, and ultraviolet light degradation, provided these additives do not affect the electrical profile of the wire/cable coating and resultant article. Lubricants and mold release agents, colorants (including dyes and pigments), fibrous and particulate fillers, fibrous and particulate reinforcements, nucleating agents, and plasticizers, may be added to the invention for enhanced properties and/or reduced cost.

The stabilizers can be incorporated into the coating composition at any stage in the preparation of the coating. Preferably the stabilizers are included at an early stage in blending to preclude initiation of degradation of the blend. The stabilizers used herein should be compatible with the composition.

The oxidative and thermal stabilizers useful in the materials of the present invention include those used generally in these types of polymers. The stabilizers can be used in amounts up to 1 percent by weight, based on the weight of the total blend. Hindered phenols such as Irganox 1010, and Irganox MD. 1026, available from Ciba Geigy, as well as similar stabilizers which are not harmful to the electrical conductive properties of the coated wire or cable are considered as useful herein.

The ultraviolet light stabilizers, can be added in amounts up to 2.0 percent, based on the weight of the total blend. Examples of usable ultraviolet light stabilizers include various substituted resorcinols, salicylates, benzotriazoles, benzophenones, and similar materials.

Suitable lubricants and mold release agents can be added, in amounts up to 1.0 percent, based on the weight of the blend. Stearic acid, stearic alcohol, stearamides, pigments, organic dyes such as nigrosine, titanium dioxide, cadmium sulfide, cadmium sulfide selenide, phthalocyamines, ultramarine blue, and carbon black are contemplated as usable herein.

Fibrous and/or particulate fillers and/or reinforcement agents are usable herein in amounts up to 50 percent based on the weight of the blend. Carbon fibers, glass fibers, amorphous silica, asbestos, calcium silicate, aluminum silicate, magnesium carbonate, kaolin clay, chalk, powdered quartz, and mica fieldspar are contemplated as usable.

Nucleating agents are contemplated as usable herein in amounts up to 10 percent based on the weight of the composition. Talc, calcium fluoride, sodium phenyl phosphinate, alumina, and finely divided polytetrafluoroethylene are particularly usable herein.

Plasticizers are contemplated as usable herein in amounts up to about 20 percent, based on the weight of the composition. Dioctyl phthalate (DOP), dibenzyl phthalate, butyl benzyl phthalate, hydrocarbon oils, N-normal butyl benzene sulfonamide, ortho and para toluene ethyl sulfonamide are contemplated as particularly usable herein. Colorants (dyes and pigments) can be used in the invention in amounts of up to about 5.0 percent by weight, based on the weight of the blend.

It is also contemplated that the novel "polyketone only" or the "blended polyketone and polyurethane" formulations besides containing one or more of the above listed additives, can include up to 30 weight percent, based on the weight of the composition of one or more flame retardant materials. Flame retardants, such as trihydrates or or magnesium hydroxide which are capable of liberating water above the processing temperature of the polymer are usable herein. Antimony oxide, in combination with halogenated compounds such as decabromo diphenyl oxide (DBDPO), is considered usable herein, though DBDPO can be used alone. Cyloaliphatic chlorine compounds, zinc or barium borate, and phosphate compounds can also be used as flame retardant additives.

It is to be understood that in the specification and claims herein, unless otherwise indicated, the amount of the urethane polymer or polyketone polymer for the coating is expressed in terms of percent by weight, it is meant percent by weight based on the total amount of the blend.

The physical properties described in the following Tables I–III detail the unique features of the polyketone polymer blends with polyurethane polymer used herein.

Illustrative Formulations

The following illustrative formulations will provide more detail regarding the invention. These examples are not intended to limit the scope of the present invention.

Illustrative Embodiment I

Polyketone A was a linear alternating terpolymer. Polyketone A was known as polyketone 088/047 comprised of carbon monoxide, ethylene and propylene, and was produced in the presence of a catalyst composition formed from palladium acetate, the anion of trifluoroacetic acid and 1,3-bis[di(2-methyloxyphenylphosphino]propane. The terpolymer Polyketone A, had a melting point of 220° C. and a limiting viscosity number (LVN) of 2.09 as measured in m-cresol at 60° C. Polyketone A had a propylene comonomer content of about 6.5%. Additionally, Polyketone A was stabilized with 0.1 wt % of an alumina/hydrogel, 1.25 wt % ethylene ethyl acrylic acid, 0.5 wt % glycerol monostearate, 0.5 wt % of a hindered phenol, Irganox 1330 made by Ciba Geigy.

Pellets of the novel polymer were fed into a 1½ inch Brabender single screw extruder. Pellets could be starve fed or flood fed into the polymer. The temperature zone profiles in the Brabender extruder were as follows:

Zone 1 210° C.
Zone 2 225° C.
Zone 3 240° C.
Zone 4 245° C.

The polymer blend was extruded through a conventional cross-head die in order to form the coated wire. The die temperature was maintained at 440° F. The pressure in the die was about 1800 to 1900 psi. The wire which was coated in the die was on a Camden 18 AWG 16 strand x 30 gauge copper wire. The outer diameter of the coated copper wire was 107 O.D. The actual wall thickness of the coating (without the wire) was about 30 to 35 mils.

Illustrative Embodiment II

This Embodiment used Polyketone B 087/014, a composition that comprised linear alternating terpolymer of carbon monoxide, ethylene and propylene produced in the presence of a catalyst composition formed from palladium acetate, the anion of trifluoroacetic acid and 1,3-bis[di(2-methoxyphenyl phosphino]propane. Polyketone B had a melting point of 196° C. and an LVN of 1.68 as measured in m-cresol at 60° C. The propylene comonomer content was about 12%. Polyketone B, additionally contained approximately 0.5 wt % of Irganox 1076 and and 0.2% BHT.

A blend of a Polyketone B was prepared with 10% by weight, based on the total blend, of Estane 58113 polyurethane. Estane 58113 polyurethane is available from BF Goodrich.

The blend was prepared by first tumbling pellets of Polyketone B with pellets of polyurethane in a tumbler. After tumbling, the combined pellets were fed into a 30 mm twin screw Haake extruder. The resulting polymer blend was extruded into strands, quenched in water and chopped into pellets.

Pellets were in turn fed into another extruder, a 1½ inch Brabender single screw extruder. The zone profiles in the Brabender extruder were as follows:

Zone 1 200° C.
Zone 2 205° C.
Zone 3 210° C.
Zone 4 215° C.

The polymer blend was extruded through a conventional cross head die in order to form coated wire. The die temperature was maintained at 440° F. The pressure in the die was about 1400 to about 1500 psi. The wire coated in the die was on a Camden 18 AWG 16 strand x 30 gauge copper wire. The outer diameter of the resultant coated copper wire was 107 O.D. The actual wall thickness of the coating without the wire was about 30–35 mils.

Illustrative Embodiment III

A blend of the terpolymer, Polyketone B described in Embodiment II, was prepared with 50% by weight based on the total blend of Estane 58881 polyurethane available from B. F. Goodrich.

The blend was prepared by first tumbling pellets of polykeytone B with pellets of polyurethane in a drum. After tumbling, the combined pellets, were fed into a 30 mm twin screw Haake extruder. The resulting polymer blend was extruded into strands, quenched into water and chopped into pellets. Pellets were in turn, fed into another extruder, a 1½ inch Brabender single screw extruder. The zone profile in the Brabender extruder were as follows:

Zone 1 200° C.
Zone 2 205° C.
Zone 3 210° C.
Zone 4 215° C.

The polymer blend was extruded through a conventional cross-head die in order to form coated wire. The die temperature was maintained at 440° F. The pressure in the die was about 900–1000 psi. The wire coating which occurred in the die, was on a Camden 18 AWG 16 strand x 30 gauge copper wire. The outer diameter of the resulting coated copper wire was 112 O.D. The actual thickness of the coating without the wire was about 30–35 mils.

The above formulations were further tested using the ZGL testing device which employs a pneumatic drive, piezoelectric transducer, automatic data acquisition and analysis and user-friendly software and reporting. An environment chamber controls humidity as well as temperature.

Speeds up to 5000 in/min result in ZGL failure events of 100–500 μsec duration. Local strain rates can be produced in the ZGL specimens that are comparable to those in the first incremental deformation at the notch during an Izod test. In Izod failure, however, the local strain rate slows to zero as the hammer decelerates and the failure apex approaches the "hinge" region. In the ZGL test, on the other hand, the selected velocity is maintained throughout the event, making it a more severe method. Impact values obtained in this constant velocity mode and expressed as per Izod geometry are indeed lower than Izod values on comparable materials. The results appear on Table I.

The use of the polyurethane of the present invention with the polyketones advantageously provides a high impact, wire and cable coating. The toughness of the base blend as tested without the wire care can be seen in the ZGL test results for blends of Polyketone B (87/014) with Estane 58133 appear in Table II. That blend and other blends of Polyketone B with Estane 58881 and 58810 were compression molded into plaques between 5–30 mils in thickness at 245° C. for 1½ minutes using a Carver hydraulic press and tested in regard to modulus, elongation and energy to break, as shown in Table III. For tensile strength tests, the plaques were cut into microtensile specimens having a dumbbell shape similar to specimens formed using ASTM D1708 test dies. The specimens described were tested in a minimaterials test made by Polymer Laboratories.

It is anticipated that the present invention can be used to form coatings 3 mil to 300 mils in dimension. More specifically, it is anticipated that this novel wire and/or cable invention can be used for ignition cables for automobiles, or similar vehicles or motors, electrical products requiring a U.L. of 90 to 105, such as wire or cable jackets, a $V_o$ grade jacketing, portable cordage, electrical insulation, and most electrical applications, requiring the passage of current having 600 volts or less.

As many widely different embodiments of this invention may be made without departing from the spirit and scope therefor, it is to be understood that this invention is not limited to the specific embodiments thereof except as defined in the claims.

TABLE I

| FORMULATION | TENSILE STRENGTH, BREAK PSI[1] | TANGENT MODULUS PSI[1] | ELONGATION[1] % |
|---|---|---|---|
| Polyketone A | 7240 | 230,000 | 70 |
| Polyketone B | 6510 | 208,000 | 40 |
| Illustrative Embodiment II[2] | 7750 | 202,000 | 260 |
| Illustrative Embodiment III | 1560 | 1230 | 105 |

[1]Using test method ASTM D638, using an Instron Series IX automates materials testing system

[2]Illustrative Embodiment II is the 90/10 blend of 90% polyketone with 10% polyurethane.

TABLE II

ZGL Test Data

| COMPOSITION | RATIO | IMPACT STRENGTH KJ/M2 |
|---|---|---|
| CARILON 87/014/ESTANE 58133 | 20/80 | 80.6 |

TABLE II-continued

ZGL Test Data

| COMPOSITION | RATIO | IMPACT STRENGTH KJ/M2 |
|---|---|---|
| CARILON 87/014/ESTANE 58133 | 20/80 | 132.7 |
| CARILON 87/014/ESTANE 58133 | 20/80 | 32.6 |
| CARILON 87/014/ESTANE 58133 | 40/60 | 90.8 |
| CARILON 87/014/ESTANE 58133 | 40/60 | 92.5 |
| CARILON 87/014/ESTANE 58133 | 40/60 | 61.6 |
| CARILON 87/014/ESTANE 58133 | 40/60 | 113.3 |
| CARILON 87/014/ESTANE 58133 | 60/40 | 81.8 |
| CARILON 87/014/ESTANE 58133 | 60/40 | 152.2 |
| CARILON 87/014/ESTANE 58133 | 60/40 | 123.1 |
| CARILON 87/014/ESTANE 58133 | 60/40 | 169.8 |
| CARILON 87/014/ESTANE 58133 | 60/40 | 77.8 |
| CARILON 87/014/ESTANE 58133 | 80/20 | 81 |
| CARILON 87/014/ESTANE 58133 | 80/20 | 102 |
| CARILON 87/014/ESTANE 58133 | 80/20 | 67.8 |
| CARILON 87/014/ESTANE 58133 | 80/20 | 61.9 |
| CARILON 87/014/ESTANE 58133 | 0/100 | 155.6 |
| CARILON 87/014/ESTANE 58133 | 0/100 | 123.7 |
| CARILON 87/014/ESTANE 58133 | 0/100 | 114.6 |
| CARILON 87/014/ESTANE 58133 | 0/100 | 124.4 |
| CARILON 87/014/ESTANE 51833 | 0/100 | 93.5 |

Carilon 87/014 is a polyketone terpolymer with a mp of 195° C.
Polyketone B is 100% Carilon 87/014.

TABLE III

Microtensile Testing Data Using Carilon 87/014

| CARILON/ESTANE (%)/(%) | | AVERAGE TENSILE STRENGTH (KPSI) | AVERAGE MODULUS (PSI) | AVERAGE ELONGATION (%) |
|---|---|---|---|---|
| ESTANE 58881 | | | | |
| 100 | 0 | 9.553 | 128467 | 364 |
| 80 | 20 | 4.216 | 67163 | 66 |
| 60 | 40 | 2.290 | 26483 | 79 |
| 40 | 60 | 1.969 | 7166 | 276 |
| 20 | 80 | 2.278 | 3162 | 542 |
| 0 | 100 | 1.818 | 1965 | 542 |
| ESTANE 58810 | | | | |
| 100 | 0 | 9.553 | 128467 | 364 |
| 80 | 20 | 4.647 | 82163 | 52 |
| 60 | 40 | 4.206 | 48618 | 168 |
| 40 | 60 | 3.733 | 21063 | 283 |
| 20 | 80 | 4.269 | 10805 | 439 |
| 0 | 100 | 3.973 | 6570 | 536 |
| ESTANE 58133 | | | | |
| 100 | 0 | 9.553 | 128467 | 364 |
| 80 | 20 | 7.112 | 85197 | 276 |
| 60 | 40 | 7.965 | 53030 | 376 |
| 40 | 60 | 7.987 | 37270 | 424 |
| 20 | 80 | 8.095 | 24070 | 443 |
| 0 | 100 | 8.310 | 18353 | 511 |
| ESTANE 58812 | | | | |
| 100 | 0 | 9.553 | 128467 | 364 |
| 80 | 20 | 8.571 | 90278 | 387 |
| 60 | 40 | 3.655 | 35380 | 195 |
| 40 | 60 | 2.458 | 6242 | 275 |
| 20 | 80 | 2.701 | 2181 | 535 |
| 0 | 100 | 2.424 | 1139 | 483 |

What is claimed:

1. A coated wire wherein the wire coating comprises a blend of Component A, a linear alternating polymer of carbon monoxide and at least one ethylenically unsaturated hydrocarbon, and Component B, a polyurethane polymer.

2. A coated cable wherein the coating comprises a blend of Component A, a linear alternating polymer of carbon monoxide and at least one ethylenically unsaturated hydrocarbon, and Component B, a polyurethane polymer.

* * * * *